United States Patent [19]

Kampfer et al.

[11] Patent Number: 4,576,907

[45] Date of Patent: Mar. 18, 1986

[54] COLOR-PHOTOGRAPHIC RECORDING MATERIAL

[75] Inventors: Helmut Kampfer, Cologne; Hans Langen, Bonn; Erwin Ranz, Leverkusen, all of Fed. Rep. of Germany

[73] Assignee: Agfa Gevaert Aktiengesellschaft, Leverkusen, Fed. Rep. of Germany

[21] Appl. No.: 645,275

[22] Filed: Aug. 29, 1984

[30] Foreign Application Priority Data

Sep. 10, 1983 [DE] Fed. Rep. of Germany ..... 3332688

[51] Int. Cl.[4] ..... G03C 1/02

[52] U.S. Cl. ..... 430/507; 430/551; 430/506; 430/505; 430/510; 430/611; 430/523

[58] Field of Search ..... 430/551, 611, 505, 506, 430/510, 503, 507, 523

[56] References Cited

U.S. PATENT DOCUMENTS

| | | | |
|---|---|---|---|
| 3,695,881 | 10/1972 | Luckey | 430/502 |
| 3,945,829 | 3/1976 | Zorn et al. | 430/611 |
| 4,264,721 | 4/1981 | Shimano et al. | 430/551 |
| 4,448,878 | 5/1984 | Yamamuro et al. | 430/551 |

FOREIGN PATENT DOCUMENTS 1471554 4/1977 United Kingdom .

*Primary Examiner*—Won H. Louie

*Attorney, Agent, or Firm*—Connolly and Hutz

[57] ABSTRACT

Compounds corresponding to the following formula $$(MS—Het—(Ar)_m—NR^1—CO)_n R^2$$

which are contained in a color-photographic recording material in a silver-free layer between a layer containing colloidal silver and a silver halide emulsion layer, improve the storage stability of the material.

10 Claims, No Drawings

COLOR-PHOTOGRAPHIC RECORDING MATERIAL

This invention relates to a colour-photographic recording material which has an improved fog resistance and has at least one photosensitive silver halide emulsion layer and at least one layer which contains colloidal silver.

Photographic materials, in particular colour photographic multilayer materials, are exposed to a number of disadvantageous changes during storage, among which the loss of sensitivity and the increase in fog are particularly significant. These defects occur particularly readily if the material contains layers which, in turn, contain colloidal silver as the light-absorbing medium. Such layers are positioned between the blue-sensitive and the green- and red-sensitive layers, for example as a silver yellow filter layer (according to Carey Lea) to absorb undesirable blue light. Furthermore, an anti-halation layer which contains grey, black or blue colloidal silver may be positioned under the photosensitive layers, in order to prevent the back-scatter of light into the photosensitive layers and thus to prevent a deterioration in definition.

The advantage of silver as a light-absorbing medium compared to organic dyes for filter layers is generally that the same absorption effect may be achieved with substantially thinner layers. On the other hand, a layer containing colloidal silver may have a disadvantageous effect on the photographic properties of the adjacent photosensitive dividing layers. This may be manifested, in particular during storage, by increased fog and a loss of sensitivity.

In order to reduce this fog, it is known that anti-fogging agents (anti-foggants) may be added to the relevant emulsion layers or to the filter layers containing colloidal silver. Anti-foggants which may be used include, in particular, heterocyclic compounds, such as benzimidazoles, benztriazoles and heterocyclic mercapto compounds, in particular 1-phenyl-5-mercapto-tetrazole and the 1-amidophenyl- and 1-ureidophenyl derivatives thereof.

According to DE-A No. 1,547,694 and U.S. Pat. No. 3,397,987, the fog in the case of mixtures of fogged and unfogged emulsions should be prevented by adding mercaptotetrazoles to silver halide emulsions, in particular to fogged silver halide emulsions. According to DE-A No. 1,942,883 and U.S. Pat. No. 3,708,303, the dot quality in the case of high-contrast silver halide emulsions which consist of at least 50% of chloride should be improved using amidophenyl mercaptotetrazoles. These compounds can be incorporated in a photographic emulsion layer or a layer contiguous thereto. These recording materials are not colour-photographic recording materials, but black-and-white materials which have to be developed with very special developers (Lith developers). U.S. Pat. No. 3,695,881 discloses a process for the production of images, in which iodide ions from an emulsion containing silver iodide increase the solubility of another emulsion which is treated with a phenyl-mercaptotetrazole. According to DE-A No. 2,437,353 and GB-A No. 1,471,554 impurities caused by silver are to be avoided during the development of black-and-white materials by developing in the presence of amidophenyl mercaptotetrazoles. It is known from DE-A No. 2,336,721 and U.S. Pat. No. 3,945,829 that heterocyclic mercapto compounds may be used in a layer containing colloidal silver to reduce the fog. According to EP No. 0,080,631 ureidophenyl mercaptotetrazoles should suppress the fog in photographic materials, without impairing the materials' bleaching ability. The compounds can be incorporated into e.g. a silver halide emulsion layer into a colloid silver layer and into an auxiliary layer. It is known from various patents (DE No. 2,163,546; U.S. Pat. Nos. 3,715,208; 3,705,802) and others that mercapto compounds may be used as bleaching inhibitors during the production of silver tone traces.

Although the proposed compounds, in particular the mercapto-tetrazole derivatives include anti-foggants which have an outstanding effect, such anti-foggants usually suffer from the serious disadvantage that they reduce the photographic sensitivity to a greater or lesser extent, they are capable of hindering the bleaching of the developed silver during processing or, as a result of diffusing into adjacent photosensitive layers, they contribute towards disadvantageous changes in the photographic properties while in such layers.

An object of the present invention is to provide an improved colour-photographic material which has at least one photosensitive silver halide emulsion layer and at least one layer containing colloidal silver.

A colour-photographic recording material has been found which has at least one photosensitive silver halide emulsion layer, at least one layer which contains colloidal silver and at least one silver-free layer positioned between these layers. According to the present invention, the material contains in the silver-free layer at least one compound I corresponding to the following formula $$(MS—Het—(Ar)_m—NR^1—CO)_nR^2$$

wherein $R^1$ represents hydrogen or an optionally substituted aliphatic radical having from 1 to 6 carbon atoms, $R^2$ represents an n-valent, optionally substituted aliphatic radical having from 4 to 17 carbon atoms when n represents 1, and having from 2 to 17 carbon atoms when n represents 2, m represents 0 or 1, n represents 1 or 2, and M represents hydrogen, an alkali metal atom or an ammonium group, Ar represents a bivalent optionally substituted aromatic radical, preferably phenylene and naphthylene, e.g. of the formula

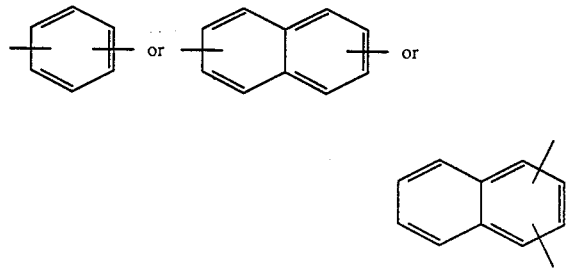

Het represents a bivalent heterocyclic radical containing at least one N-atom and which may be substituted, e.g. a radical comprising a ring system with 5 ring members, especially a thiazole, selenazole, imidazole, oxadiazole and preferably a tetrazole, oxazole, triazole or thiadiazole.

In an especially preferred embodiment, the anti-foggants correspond to formula Ia

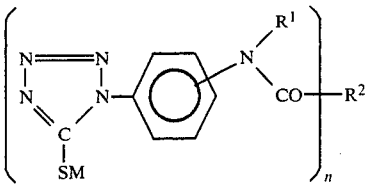

Ia wherein the substituents have the meaning indicated above.

Substituents which are suitable for $R^1$, $R^2$, Ar and Het are those which are suitable for anti-foggants in photosensitive silver halide materials, for example hydroxy, alkoxy, for example methoxy or ethoxy, and halogen, such as fluorine, chlorine or bromine. Especially Het may be substituted with an aryl radical, preferably phenyl.

In a preferred embodiment, $R^1$ represents hydrogen or an alkyl radical. In another preferred embodiment, $R^2$ represents an alkyl radical. M preferably represents hydrogen.

In one particularly preferred embodiment, the recording material has at least one blue-sensitive layer, at least one green-sensitive layer, and at least one red-sensitive layer. In a preferred embodiment, the layer containing colloidal silver is a yellow filter layer, the silver-free layer with a compound I being positioned between the yellow filter layer and a green- or red-sensitive layer.

In another preferred embodiment, the material according to the present invention has in each case at least one blue-, green- and red-sensitive layer and an anti-halation layer comprising of colloidal silver, a silver-free layer with the compound I to be used according to the present invention being positioned between the anti-halation layer and the layers mentioned above.

The compounds to be used according to this invention are preferably added to the silver-free layers in quantities of from $10^{-2}$ to $10^{-8}$ mol/m$^2$, preferably in quantities of from $10^{-4}$ to $10^{-6}$ mol/m$^2$.

Typical compounds which are to be used according to the present invention and which correspond to the general formula given above are set out in the following Table 1.

TABLE 1

| No | |
|---|---|
| 1. | 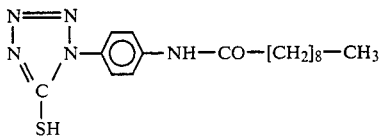 |
| 2. | 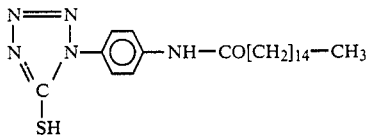 |

TABLE 1-continued

| No | |
|---|---|
| 3. | 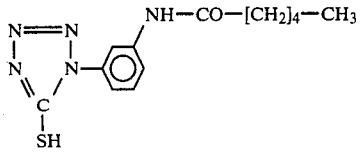 |
| 4. | 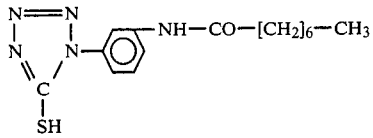 |
| 5. | 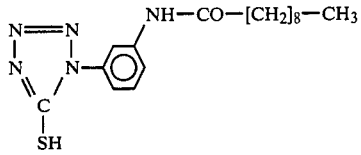 |
| 6. | 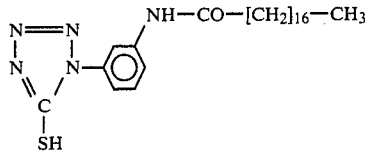 |
| 7. | 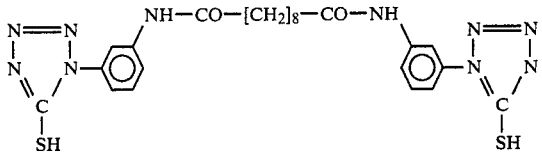 |
| 8. | 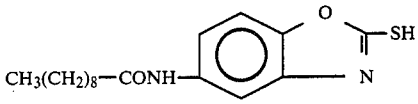 |
| 9. | 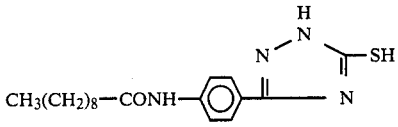 |
| 10. | 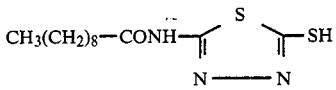 |
| 11. | 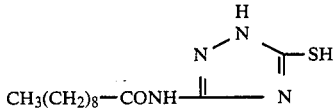 |
| 12. | 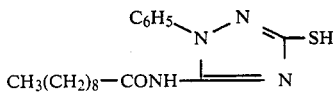 |

Colour-photographic images may be produced with the material according to the present invention by the most varied processes, for example by the silver dye bleaching process or by the dye diffusion process. The material of this invention is particularly suitable for the production of colour-photographic images by chromogenic development in the presence of colour couplers which react with the oxidation product of developers, in general p-phenylene diamines, with the formation of dyes.

The colour couplers may be added to the colour developer. In a preferred embodiment, the photographic material itself contains the conventional colour couplers which are usually incorporated into the silver halide layers. Thus, the red-sensitive layer may contain, for example, a non-diffusing colour coupler to produce the cyan partial colour image, usually a coupler of the phenol or α-naphthol type. The green-sensitive layer may contain, for example at least one non-diffusing colour coupler to produce the magenta partial colour image, colour couplers of the 5-pyrazolone type or of the imidazolone type usually being used. The blue-sensitive layer may contain, for example, a non-diffusing colour coupler to produce the yellow partial colour image, usually a colour coupler which has an open-chain ketomethylene group. The colour couplers may be, for example, 6-, 4- and 2-equivalent couplers, including the so-called white couplers which do not produce a dye when reacted with colour developer oxidation products, and also DIR couplers. Suitable couplers are known for example from the publications: "Farkuppler" by W. Pelz in "Mitteilungen aus den Forschungslaboratorien der Agfa", Leverkusen/Munich, Volume III, page 111 (1961), K. Venkataraman in "The Chemistry of Synthetic Dyes", Vol. 4, 341 to 387, Academic Press (1971) and T. H. James, "The Theory of the Photographic Process", 4.Ed., P. 353–362 and from Research Disclosure No. 17643 of December 1978, Section VII.

The colour-photographic recording materials according to the present invention preferably contain at least one silver halide emulsion layer unit for recording light of each of the three spectral ranges: red, green and blue. Each of these layer units may comprise a single silver halide emulsion layer or several silver-halide emulsion layers. Colour-photographic recording materials which have double layers for the different spectral ranges are known, for example, from U.S. Pat. Nos. 3,663,228, 3,849,138 and 4,184,876.

The silver halide emulsions which are used may contain, as halide, chloride, bromide or iodide, or mixtures thereof. In a preferred embodiment, the halide proportion of at least one layer consists of 0–10 mol% of AgI, 0–10 mol% of AgCl and 0–100% of AgBr, the total of these proportions amounting to 100%. In another embodiment, the halide proportion may also mainly consist of chloride. The silver halide grains may be, for example, cubic, octahedral or tabular.

The emulsions may be optionally sensitised in a known manner, for example by means of conventional polymethine dyes such as neutrocyanines, basic or acidic carbocyanines, rhodacyanines, hemicyanines, styryl dyes, oxonoles and the like. Sensitizers of this type are described by F. M. Hamer in "The Cyanine Dyes and related Compounds" (1964). In this respect, reference is made in particular to Ullmanns Enzyklopädie der technischen Chemie, 4th edition, Volume 18, Pages 431 et seq, and to the Research Disclosure mentioned above, No. 17643, Section IV.

Conventional anti-foggants and stabilizers may be used in addition to the anti-foggants which are to be used according to this invention.

Azaindenes, preferably tetra- or penta-azaindenes, are particularly suitable as stabilizers, and especially such azaindenes which are substituted with hydroxyl or amino groups. Compounds of this type are described in, for example, the article/by Birr, Z. Wiss. Phot.47, 1952, P.2–58. Other suitable stabilizers and anti-foggants are specified in the above-mentioned Research Disclosure No. 17643 in Section IV.

Conventional substrates may be used for the materials of this invention, for example substrates of cellulose esters, for example cellulose acetate, and of polyesters. Paper substrates are also suitable, which may be coated with, for example, polyolefins, in particular with polyethylene or polypropylene. In this respect, reference is made to the above-mentioned Research Disclosure No. 17643, Section XVII.

The conventional hydrophilic film-forming agents are suitable as protective colloids or binders for the layers of the recording material, for example proteins, in particular gelatin, alginic acid or derivatives thereof, such as esters, amides, or salts, cellulose derivatives, such as carboxymethyl cellulose and cellulose sulphates, starch or derivatives thereof or hydrophilic synthetic binders, such as polyvinyl alcohol, partially saponified polyvinyl acetate, polyvinyl pyrrolidone and the like. The layers may contain, in admixture with the hydrophilic binders, other synthetic binders, in a dissolved or dispersed form, such as homopolymers or copolymers of acrylic acid or methacrylic acid or derivatives thereof, such as esters, amides, or nitriles, also vinylpolymers, such as vinylesters, or vinylethers. Reference is also made to the binders specified in the above-mentioned Research Disclosure 17643 in Section IX.

The layers of the photographic material may be hardened in a conventional manner, for example using formaldehyde, or by means of hardners of the epoxide type, the heterocyclic ethylene imine type and the acryloyl type. Furthermore, it is also possible to harden the layers according to the process of German Offenlegungsschrift No. 2,218,009 in order to obtain colour-photographic materials which are suitable for high-temperature processing. Moreover, it is possible to harden the photographic layers or the colour-photographic multilayer materials by means of hardeners of the diazine, triazine or 1,2-dihydroquinoline series, or using hardeners of the vinyl sulphone type.

Other suitable hardeners are specified in, for example, the above-mentioned Research Disclosure 17643 in Section XI.

Other suitable additives are mentioned in Research Disclosure 17643 and in "Product Licensing Index" of December 1971, Pages 107–110.

Colour developer substances which are suitable for the material of this invention are, in particular, those of the p-phenylene diamine type, for example 4-amino-N,N-diethyl-aniline hydrochloride; 4-amino-3-methyl-N-ethyl-N-β-(methanesulphonamido)-ethylanilinesulphatehydrate; 4-amino-3-methyl-N-ethyl-N-β-hydroxyethylanilinesulphate; 4-amino-N-ethyl-N-(2-methoxyethyl)-m-toluidine-di-p-toluenesulphonic acid and N-ethyl-N-β-hydroxyethyl-p-phenylenediamine.

Other developers which may be used are described in, for example, J. Amer.Chem.Soc.73, 3100 (1951) and by G. Haist in Modern Photographic Processing, 1979, John Wiley and Sons, New York, Pages 545 et seq.

After the colour development, the material is bleached and fixed in a conventional manner. Bleaching and fixing may be carried out together or separately. The conventional compounds may be used as bleaching agents, for example $Fe^{3+}$ salts and $Fe^{3+}$ complex salts such as ferricyanides, dichromates and water-soluble cobalt complexes etc. Iron-III-complexes of amino polycarboxylic acids are particularly preferred, in particular, for example, ethylenediaminetetra-acetic acid, nitrilotriacetic acid, iminodiacetic acid, N-hydroxyethylethylenediaminetriacetic acid, alkyliminodicarboxylic acid, and of corresponding phosphonic acids. Persulphates are also suitable as bleaching agents.

EXAMPLE 1

The layers specified in the following are successively applied to a cellulose triacetate substrate which is provided with an anti-halation layer and an adhesive layer. The specified quantities relate in such case to one square meter. The silver application is shown by the stated equimolar quantities of silver nitrate:

1. Red-sensitive layer of low sensitivity.
   The layer contains a silverbromoiodide emulsion (6 mol % of silver iodide), a cyan coupler, a DIR-coupler, and a mask coupler. Silver application: 3.4 g.
2. Red-sensitive layer of high sensitivity.
   The layer contains a silver bromoiodide emulsion with 10 mol % of silver iodide, and a cyan coupler. Silver application: 2.2 g.
3. Intermediate Layer
   The intermediate layer contains 0.7 g of gelatin, 0.09 g of a scavenger, dispersed therein, for developer oxidation products and corresponding to the following formula:

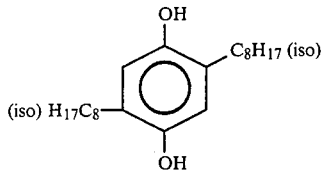

4. Green-sensitive layer of low sensitivity.
   The layer contains a silver bromoiodide emulsion (6 mol % of silver iodide) and a magenta coupler of the pyrazolone type, a DIR-coupler and a yellow mask coupler. Silver application: 2.2 g.
5. Green-sensitive layer of high sensitivity.
   The layer contains a silver bromoiodide emulsion (10 mol % of silver iodide) and a magenta coupler, dispersed therein, of the pyrazolone type.
6. Intermediate layer.
   The intermediate layer contains 0.5 g of gelatin, the scavenger for developer oxidation products which is dispersed therein and is stated under layer 3 and optionally the anti-foggants specified in the following Table 2.
7. Yellow filter layer.
   The yellow filter layer contains colloidal silver. Density: 0.7.
8. Blue-sensitive layer of low sensitivity.
   The layer contains a silver bromoiodide emulsion (5 mol % of silver iodide) and a mixture of yellow couplers of the benzoyl-acetanilide type dispersed therein.
9. Blue-sensitive layer of high sensitivity.
   The layer contains a blue-sensitive layer with 6 mol % of silver iodide, and a mixture of the yellow couplers stated under layer 8.
10. UV absorber layer.
    The layer contains 0.8 g of a UV absorber of the benzotriazole type, dispersed in gelatin.
11. Cover layer.

The cover layer consists of hardened gelatin.

Samples of materials composed in this manner are exposed behind a step wedge and subjected to conventional colour negative processing, as described in British Journal of Photography, 1974, Page 597. Before being evaluated, the samples were exposed to the following storage conditions A to test the storage stability: seven days storage at a temperature of 35° C., 90% relative humidity and with the exclusion of light.

The values obtained from this test were compared with the values which were obtained after storage under normal conditions B: seven days storage at a temperature of 20° C. and 60% relative humidity. The following Table 2 states the changes as a result of storage under the conditions A compared with storage B (in each case sensitivity or fog difference B−A).

TABLE 2

| Structure | Compound added mg/m² | Changes due to storage A Green sensitivity decrease | Magenta fog increase |
|---|---|---|---|
| A | without | 6.7 DIN | 0.25 |
| B | 4.2 comp. 1 | 3.4 DIN | 0.06 |
| C | 5.2 comp. 2 | 6.0 DIN | 0.21 |
| D | 3.5 comp. 3 | 2.9 DIN | 0.02 |
| E | 3.8 comp. 4 | 3.2 DIN | 0.03 |
| F | 4.2 comp. 5 | 3.5 DIN | 0.07 |
| G | 5.5 comp. 6 | 6.1 DIN | 0.21 |
| H | 3.3 comp. 7 | 2.8 DIN | 0.03 |
| J | 4.1 comp. 8 | 4.3 DIN | 0.08 |
| K | 9.0 comp. 9 | 3.7 DIN | 0.09 |
| L | 7.3 comp. 10 | 2.4 DIN | 0.04 |

A decrease in sensitivity of 3 DIN corresponds to a halving of the sensitivity.

It may be clearly seen that when the compounds 1–7 which are to be used according to this invention are added, there is a clearly lower loss of sensitivity and a clearly lower increase in fog compared to when these compounds are absent.

EXAMPLE 2

Five different materials I to Q were produced according to the general structural scheme stated in Example 1. They differed from each other in that the compounds specified in the following Table 3 were added to the intermediate layer stated under 6 between the yellow filter layer and the green-sensitive layer of high sensitivity.

TABLE 3

| Structure | mg/m² | compound | Decrease in sensitivity/ green | Increase in fog/ magenta |
|---|---|---|---|---|
| M | without | — | 6.5 DIN | 0.26 |
| N | 2.0 | 5 | 5.2 DIN | 0.20 |
| O | 4.0 | 5 | 3.7 DIN | 0.08 |
| P | 8.0 | 5 | 2.9 DIN | 0.01 |
| Q | 16.0 | 5 | 2.3 DIN | −0.04 (fog reduction) |

It may be seen from Example 2 that with an increasing quantity of the compounds to be used according to this invention, the increase in fog which takes place during storage A is reduced.

EXAMPLE 3

A recording material is produced according to Example 1, structure A, but the compounds to be used according to this invention which are stated in the following Table 4 were introduced into the adhesive layer between the anti-halation layer consisting of colloidal silver and the red-sensitive layer of low sensitivity. The material is stored as described in Example 1 under the storage conditions A and B, then exposed and developed as stated in Example 1.

TABLE 4

| Structure | Compound [mg] | Changes caused by Decrease in red-sensitivity | Storage A Increase in cyan fog |
|---|---|---|---|
| R | 10 mg of compound 1 | −2.4 DIN | 0.00 |
| S | without | −2.9 DIN | 0.06 |

It may be seen from the results of Table 4 that as a result of embedding a compound to be used according to the present invention in the adhesive layer, there is a clear fog stability in the cyan layer structure and a smaller decrease in sensitivity.

We claim:

1. A colour-photographic recording material which has at least one photosensitive silver halide emulsion layer, at least one layer which contains colloidal silver and at least one silver-free layer positioned between these layers, at least one anti-foggant contained in said silver-free layer and said anti-foggant corresponding to the following formula:

$$(MS—Het—(Ar)_m—NR^1—CO)_nR^2$$

wherein $R^1$ represents hydrogen or an optionally substituted aliphatic radical having from 1 to 6 carbon atoms, $R^2$ represents an n-valent, optionally substituted aliphatic radical having from 4 to 17 carbon atoms when n represents 1, and having from 2 to 17 carbon atoms when n represents 2, m represents 0 or 1, n represents 1 or 2, M represents hydrogen, an alkali metal atom or an ammonium group, Ar represents a bivalent optionally substituted aromatic radical, Het represents a bivalent heterocyclic radical containing at least one N-atom and which may be substituted.

2. A material according to claim 1, characterised in that the anti-foggant corresponds to the following formula

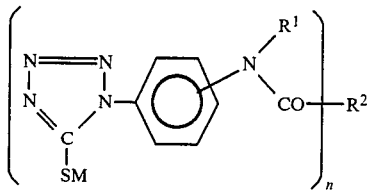

wherein the substituents are defined as in claim 1.

3. A material according to claim 1, characterised in that it contains at least one colour coupler.

4. A material according to claim 1, characterised in that it contains at least one blue-sensitive layer at least one green-sensitive layer and at least one red-sensitive layer, the layer containing colloidal silver is a yellow filter layer, and the silver-free layer is positioned between the yellow filter layer and a green-sensitive layer or a red-sensitive layer.

5. A material according to claim 1, characterized in that it contains at least one blue-, green- and red-sensitive layer and an anti-halation layer consisting of colloidal silver, and the silver-free layer is positioned between the anti-halation layer and the other layers.

6. A material according to claim 1, characterized in that it contains the compound corresponding to formula I in a quantity of from $10^{-2}$ to $10^{-8}$ mol/m$^2$.

7. A material according to claim 1, characterized in that it contains the compound corresponding to formula I in a quantity of from $10^{-4}$ to $10^{-6}$ mol/m$^2$.

8. A material according to claim 1, characterized in that at least one photosensitive silver halide emulsion layer is divided into at least two partial layers which differ in sensitivity.

9. A material according to claim 1, characterized in that the silver halide of the photosensitive silver halide emulsion layer consists of 0.10 mol% of silver iodide, 0–10 mol% of silver chloride and 0–100 mol% of silver bromide, the total of these proportions amounting to 100%.

10. A material according to claim 1, characterized in that the photosensitive silver halide emulsion layer mainly contains silver bromide as silver halide.

* * * * *